United States Patent [19]

Fukuda

[11] Patent Number: 4,547,942

[45] Date of Patent: Oct. 22, 1985

[54] METHOD FOR PRODUCING A MUFFLER

[75] Inventor: Masuo Fukuda, Toda, Japan

[73] Assignee: Saikei Giken Kogyo Kabushiki Kaisha, Tokyo, Japan

[21] Appl. No.: 483,439

[22] Filed: Apr. 11, 1983

[30] Foreign Application Priority Data

Apr. 23, 1982 [JP] Japan ..... 57-69400

[51] Int. Cl.[4] ..... B21D 53/00; B21D 53/88

[52] U.S. Cl. ..... 29/157 R; 29/157.3 A; 29/520; 181/243; 285/382; 285/382.1; 285/382.7

[58] Field of Search ..... 29/157 R, 430, 520, 29/523, 157.3 A; 165/175, 181; 181/243; 285/382, 382.1, 382.2, 382.4, 382.5, 382.7

[56] References Cited

U.S. PATENT DOCUMENTS

| | | | |
|---|---|---|---|
| 1,787,942 | 1/1931 | Kalloch, Jr. | 29/157.3 A |
| 1,812,509 | 6/1931 | Benson | 165/181 |
| 2,053,239 | 9/1936 | Forrer et al. | 29/520 |
| 2,065,586 | 12/1936 | Hoesel | 29/520 |
| 3,921,754 | 11/1975 | Hess | 29/157 R X |
| 4,130,932 | 12/1978 | Epmeier | 285/382.5 X |

FOREIGN PATENT DOCUMENTS

| | | | |
|---|---|---|---|
| 72371 | 9/1916 | Austria | 29/157.3 A |
| 794298 | 2/1936 | France | 165/181 |
| 1168 | of 1914 | United Kingdom | 29/157.3 A |

*Primary Examiner*—Howard N. Goldberg
*Assistant Examiner*—Ronald S. Wallace
*Attorney, Agent, or Firm*—Polster, Polster and Lucchesi

[57] ABSTRACT

A method of rigidly connecting a plate and a tube such as those of a muffler associated with an internal combustion engine. The plate is formed with an eyelet by burring or like technique and, then, the tube is inserted into the eyelet as far as a predetermined position. A stop is placed to backup the plate at a flat surface of the latter where a flange produced by the eyelet is absent. This is followed by driving a die to compress the flange in such a manner as to reduce the diameter of the eyelet, thereby plastically deforming the flange. Part of the flange proportional to the decrease in diameter is caused to thrust into the periphery of the tube.

11 Claims, 16 Drawing Figures

METHOD FOR PRODUCING A MUFFLER

BACKGROUND OF THE INVENTION

1. Field of the Invention

The present invention relates to a method of producing a muffler for use with an internal combustion engine or the like which comprises an assembly of plates and tubes rigidly connected together and, more particularly, to a method which forms an eyelet in a predetermined location of a plate and inserts a tube thereinto to set up rigid connection therebetween.

2. Description of the Prior Art

A prior art muffler for an internal combustion engine or the like includes end walls which define axially opposite ends of a cylindrical casing. The interior of the casing is divided into a plurality of chambers by partition walls. Various tubes extend along the axis of the casing into, out of and within the casing while being supported by the various walls. Typical examples of the techniques heretofore employed to rigidly connect the plates and tubes may be spot welding and arc welding. However, a muffler manufactured by such a method is susceptive to corrosion due to the influence of heat. In light of this, Japanese Patent Publication No. 57-3805/82 and the parallel U.S. Pat. No. 3,921,754 issued Nov. 25, 1975, disclose a procedure in which a tube mounted in a plate is pressed from the opposite sides along its axis to form bulges at opposite sides of the plate and, then, the bulges are crimped to set up a rigid assembly of the tube and plate. A problem has existed in this method in that the tube has to be supported by a special metal core to be thereby prevented from being collapsed radially inwardly, resulting in an increase in cost and intricate assembling work.

SUMMARY OF THE INVENTION

It is therefore an object of the present invention to eliminate the drawbacks inherent in the prior art methods of producing a muffler for an internal combustion engine or the like as described above.

It is another object of the present invention to provide a method of producing a muffler for an internal combustion engine or the like which insures rigid connection of a plate and a tube while increasing the strength of the assembly against heat.

It is another object of the present invention to provide a method of producing a muffler for an internal combustion engine or the like which promotes economical production of the muffler by means of a simple device and convenient work.

It is another object of the present invention to provide a method which allows a plate and a tube to be firmly connected together by inserting the tube into an eyelet formed through the plate.

A method of rigidly connecting at least one plate and at least one tube to each other embodying the present invention includes the step of forming an eyelet through the plate such that a flange is produced which has an inside diameter substantially equal to the outside diameter of the tube. The tube is inserted into the eyelet and fixed in a predetermined position relative to the plate. Crimping means is prepared for crimping the flange of the plate and which is formed with a recess having an inside diameter substantially equal to the outside diameter of the tube. The crimping means is positioned relative to the tube through the recess. Then, the crimping means is driven until the flange of the tube becomes deformed to thrust into the outer periphery of the tube.

In accordance with the present invention, a method of rigidly connecting a plate and a tube such as those of a muffler associated with an internal combustion engine is disclosed. The plate is formed with an eyelet by burring or like technique and, then, the tube is inserted into the eyelet as far as a predetermined position. A stop is placed to back up the plate at a flat surface of the latter where a flange produced by the eyelet is absent. This is followed by driving a die to compress the flange in such a manner as to reduce the diameter of the eyelet, thereby plastically deforming the flange. Part of the flange proportional to the decrease in diameter is caused to bite the periphery of the tube.

BRIEF DESCRIPTION OF THE DRAWINGS

The objects and features of the present invention will become more apparent from a consideration of the following detailed description taken in conjunction with the accompanying drawings in which.

DESCRIPTION OF THE PREFERRED EMBODIMENTS

Figure 1:
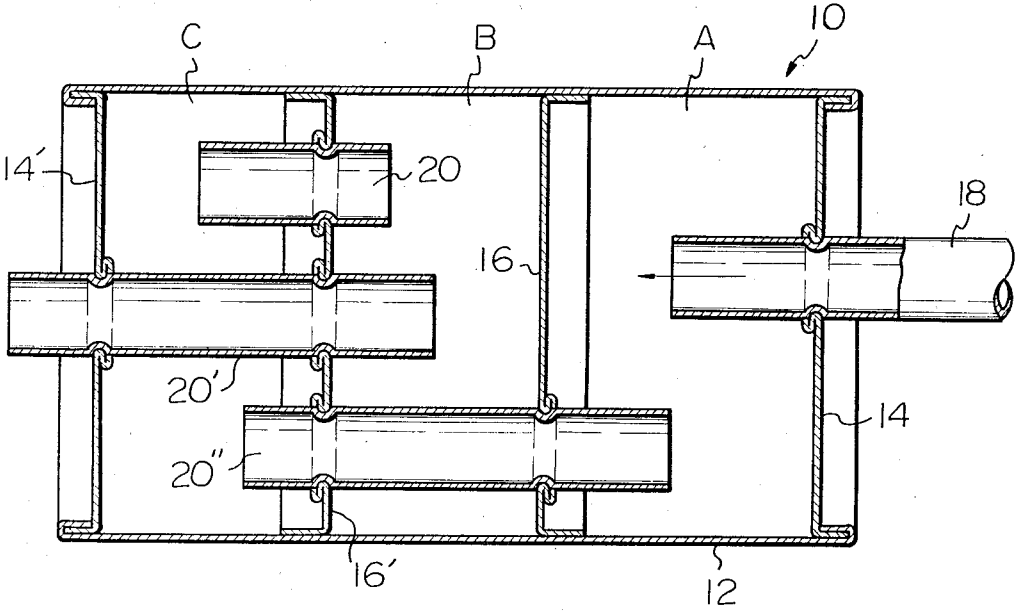
FIG. 1 is a sectional side elevation of a muffler produced by the method of the present invention.
Figure 2D:
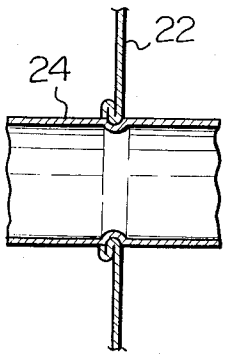
FIGS. 2*a*–2*d* are fragmentary sections showing a procedure for connecting a plate and a tube in accordance with the present invention.
Figure 2C:
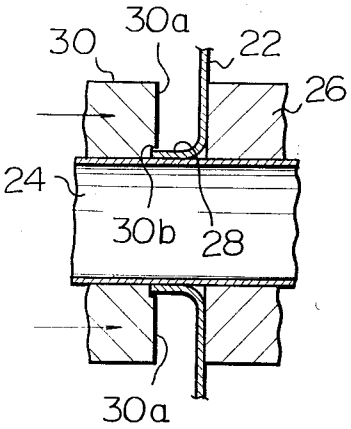
Figure 2B:
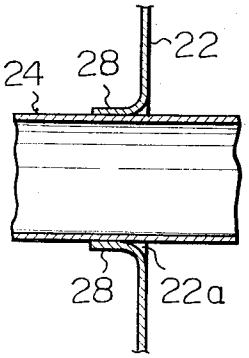
Figure 2A:
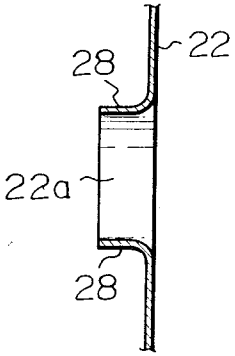

Referring to FIG. 1 of the drawings, a muffler produced by the method of the present invention is shown and generally designated by the reference numeral 10. The muffler 10 comprises a hollow cylindrical member or casing 12 whose opposite ends are closed by end walls 14 and 14' respectively. The interior of the casing 12 is divided into three chambers A, B and C by partition walls 16 and 16'. An exhaust pipe 18 extends into the chamber A through the end wall 14. The chambers B and C are intercommunicated by a tube 20 which extends through the partition 16'. The chamber B is communicated to the outside of the casing 16' by a tube 20' which extends through the partition 16' and end wall 14'. Further, the chambers A and C are intercommunicated by a tube 20'' which extends through the partition 16 and 16'.

A procedure for assembling the muffler 10 is illustrated in FIG. 2. In the drawing, a plate 22 represents the end walls and partition walls of the muffler 10 and a tube 24, the exhaust pipe and tubes. The plate 22 is formed with an eyelet 22*a* by burring which has an inside diameter substantially equal to the outside diameter of the tube 24 (FIG. 2*a*). The tube 24 is inserted into the eyelet 22*a* as far as a predetermined position (FIG. 2*b*). A stop or backup 26 is coupled over the tube 24 to contact a flat surface of the plate 22 where a flange 28 is absent and, then, a die 30 is actuated to press the flange 28 along the axis of the tube 24 which has been backed up by the stop 26 (FIG. 2*c*). The flange 28 has its distal end engaged in an annular recess 30*b* formed in the end 30*a* of the die 30, thereby being plastically turned down to the shape shown in FIG. 2*d*.

Figure 3:
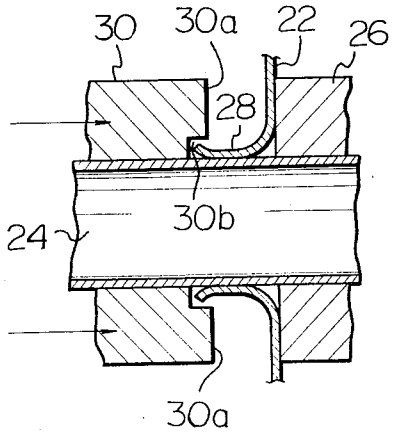
FIG. 3 is a section of a modified form of a flange formed in a plate which is connected to a tube in accordance with the present invention.

While the flange 28 undergoes progressive deformation due to the coacting stop 26 and die 30, it is prevented from collapsing from the distal end inasmuch as the distal end is engaged in the recess 30*b* of the die 30. It will be apparent that the flange 28 thrusts deeper into the periphery of the tube 24 in proportion to the mechanical strength of the tube 24 against deformation. The flange 28, as one may fear, is apt to wedge into the gap between the outer periphery of the tube 24 and the inner periphery of the die 30. This aptitude may be eliminated using the arrangement shown in FIG. 3 wherein the recess 30*b* of the die 30 has a depth larger than the thickness of the flange 28 or plate 22 and the distal end of the flange 28 is flared outwardly away from the tube 24.

Figure 4B:
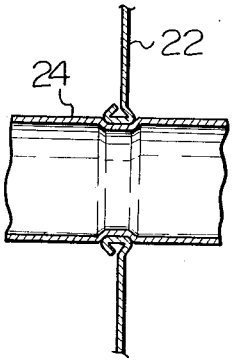
FIGS. 4*a* and 4*b* are fragmentary sections showing another example of the method of the present invention.
Figure 4A:
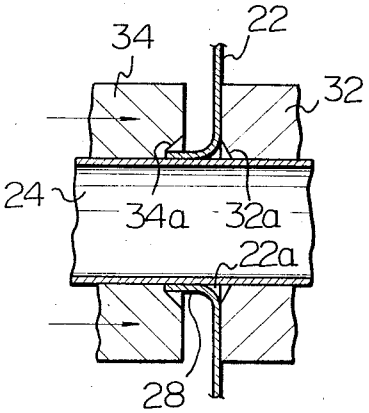

Referring to FIGS. 4*a* and 4*b*, a plate and tube assembly prepared by another example of the method of the present invention is shown. A stop 32 has an annular frustoconical recess 32*a* and a die 34, an annular frustoconical recess 34*a*. As the die 34 is driven toward the stop 32 to compress the flange 28, the flange 28 is partly urged in a direction for reducing the diameter of the eyelet 22*a* so that a fragment thereof proportional to the decrease in eyelet diameter bites the tube 24 to set up rigid connection between the plate 22 and the tube 24, as illustrated in FIG. 4*b*.

Figure 5D:
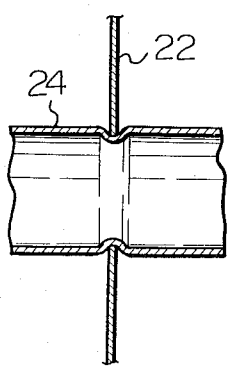
FIGS. 5*a*–5*d* are fragmentary sections showing a third example of the method of the present invention.
Figure 5C:
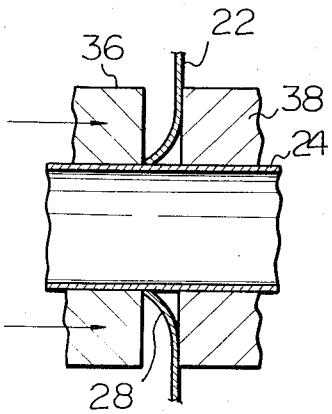
Figure 5B:
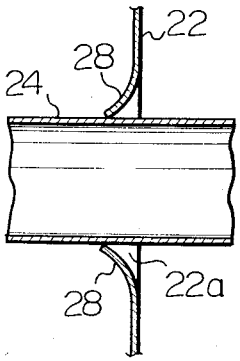
Figure 5A:
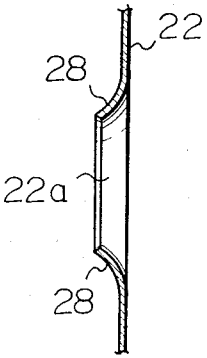

Referring to FIGS. 5*a*–5*d*, a plate and tube assembly attainable with a third example of the method of the present invention is shown. The eyelet 22*a* is so formed in the plate 22 as to produce a relatively shallow flange 28. A die 36 is driven toward a stop 38 to press the flange 28 until the flange 28 becomes flush with the rest of the plate 22 while thrusting into the tube 24. In detail, the plate 22 is burred to have an eyelet 22*a* whose inside diameter is substantially equal to the outside diameter of the tube 24 (FIG. 5*a*) and, then, the tube 24 is fit in the eyelet 22*a* to a predetermined position (FIG. 5*b*). Alternatively, the inside diameter of the eyelet 22*a* may be designed slightly smaller than the outside diameter of the tube 24 in order to press fit the tube 24 into the eyelet 22*a* such that the diameter of the eyelet 22*a* is enlarged. As in the foregoing embodiments, the die 36 having a flat work surface is driven toward the stop 38 which backs up the plate 22, thereby compressing the flange 28 along the axis of the tube 24 (FIG. 5*c*). This deforms the flange 28 until the latter becomes coplanar with the rest of the plate 22. The resulting decrease in the diameter of the eyelet 22*a* drives the annular edge of the eyelet 22*a* into the tube 24 to firmly connect the tube 24 to the plate 22 (FIG. 5*d*).

It will be noted that the die 30, 34 or 36 may compress the flange 28 over the entire circumference of the eyelet 22*a* or only part thereof, e.g., at several spaced locations along the circumference.

Figure 6:
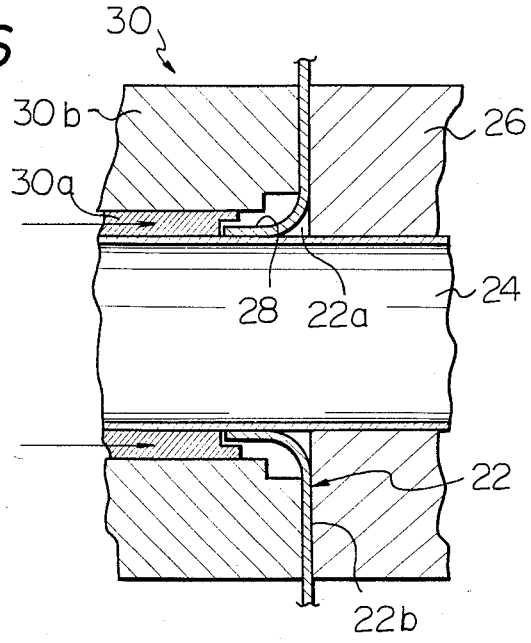
FIG. 6 is a framentary section of another possible form of a die applicable to the present invention.

As shown in FIG. 6, the die 30 may be made up of a radially inner member 30*a* for pressing the deformable flange 28 of the plate 22 against the stop 26 and a radially outer member 30*b* for retaining a non-deformable section 22*b* of the plate 22 in cooperation with the stop 26. Such a die assembly will successfully prevent the flat plate section 22*b* from being deformed and is applicable to the other dies 34 and 36 as well.

Figure 7:
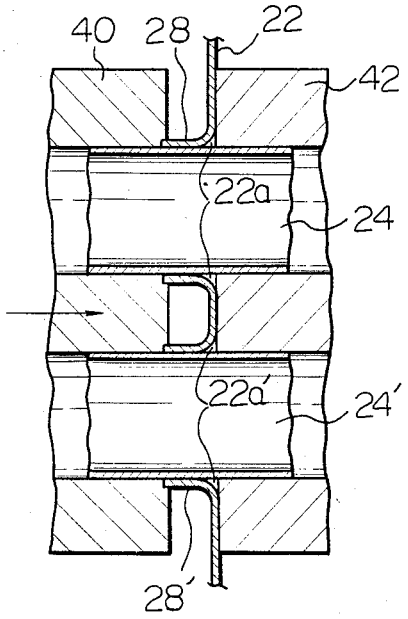
FIG. 7 is a framentary section showing a plurality of tubes rigidly connected to a single plate in accordance with the present invention.
Figure 8:
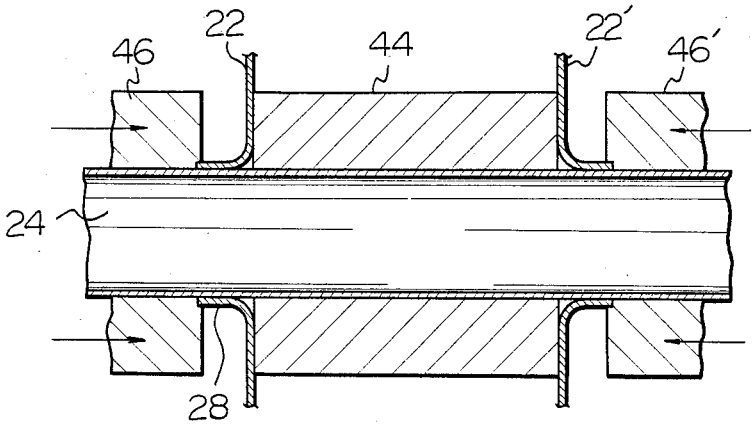
FIG. 8 is a fragmentary section showing a single tube connected to a plurality of adjacent plates in accordance with the present invention.

As shown in FIG. 7, a plurality of tubes 24 and 24' may be mounted at the same time in a single plate 22. The tubes 24 and 24' are respectively inserted into eyelets 22*a* and 22*a'* which are formed through the plate 22. A die 40 compresses the tubes 24 and 24' against a common backup or stop 42 until flanges 26 and 26' of the tubes become plastically deformed to firmly connect the tubes to the plate.

Where it is desired to attach a single tube 24 to a plurality of adjacent plates 22 and 22', a stop 44 is placed between the plates 22 and 22' as shown in FIG. 8 such that its opposite ends back up the adjacent surfaces of the plates 22 and 22'. Dies 46 and 46' are moved toward the plates 22 and 22' from opposite sides of the stop 44 to secure the tube 24 to both the plates 22 and 22'.

Figure 9:
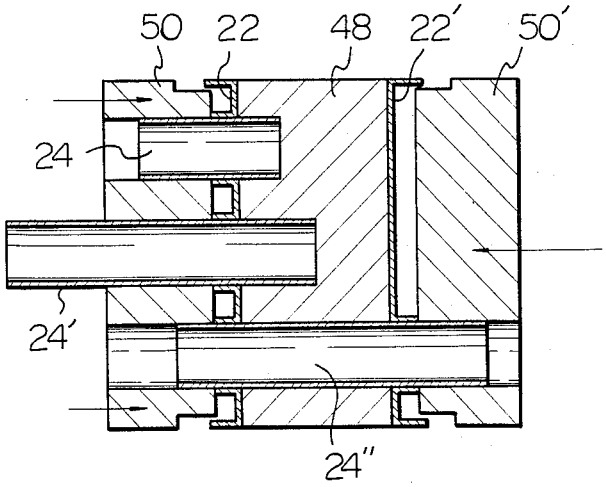
FIG. 9 is a fragmentary section showing a plurality of tubes connected to a plurality of adjacent plates in accordance with the present invention.

Furthermore, a plurality of plates 22 and 22' and a plurality of tubes 24, 24' and 24'' may be assembled at the same time in the manner shown in FIG. 9. A stop 48 is interposed between the adjacent plates 22 and 22' to back them up as dies 50 and 50' compress adjacent flanges from opposite sides of the stop 48.

In summary, it will be seen that the present invention provides a method which simply yet firmly connects various tubes of a muffler to various wall members. Because the tubes are prevented from collapsing radially inwardly without the need for any metal core or the like, the muffler can be assembled quite easily and is suitable for economical production on quantiry basis.

Various modifications will become possible for those skilled in the art after receiving the teachings of the present disclosure without departing from the scope thereof.

What I claim is:

1. A method of rigidly connecting at least one plate and at least one tube to each other, comprising the steps of:

(a) forming an eyelet through the plate such that a flange is produced which has an inside diameter substantially equal to the outside diameter of the tube, and has a portion substantially thick in the direction of the longitudinal axis of the tube;

(b) inserting the tube into said eyelet and fixing the tube in a predetermined position relative to the plate;

(c) preparing stop means for fixing the plate in position in contact with a flat surface of the plate where the flange is absent, and die means for folding the flange in cooperation with said stop means when driven along the longitudinal axis of the tube, said stop and die means each being formed with a recess having an inside diameter which is substantially equal to the outside diameter of the tube for receiving the tube therein, the recess of said die means being formed with an additional recess for receiving a portion of the flange therein, the recess of said stop means being formed with an additional recess for receiving a folded portion of the flange therein;

(d) positioning the stop and die means relative to the tube so that said recesses receive the tube therein to bring the stop and die means into abutment with the flat surface of the plate and the distal end of the flange, respectively; and (e) driving at least one of the stop and die means relatively to each other in the directions of the longitudinal axis of the tube until the portions of the flange received by the additional recesses are folded to thrust into the outer periphery of the tube.

2. A method as claimed in claim 1, in which step (a) comprises forming the eyelet to make the flange in the plate relatively shallow.

3. A method as claimed in claim 1, in which step (e) comprises (j) driving the die means toward the stop means with said stop means fixed.

4. A method as claimed in claim 1, in which the stop means is engageable with the eyelet of the plate over a flat surface thereof.

5. A method as claimed in claim 4 in which the die means is engagable with the flange of the plate over a flat surface thereof.

6. A method as claimed in claim 1, in which the additional recesses are frustoconical to be engagable with a portion of the flange.

7. A method as claimed in claim 6, in which the frustoconical recesses ae formed in a flat surface of both the die and stop means each surface being substantially perpendicular to the longitudinal axis of the tube, said recesses to be engagable with the distal end and folded portions of the flange, respectively.

8. A method as claimed in claim 1, in which the die means comprises a first section for cooperating with the stop means to retain the plate therebetween and a second section for pressing the flange toward the stop means in contact with the distal end of the flange.

9. A method as claimed in claim 8, in which step (d) comprises driving the first section of the die means into contact with the flat surface of the plate and driving the second section of the die means into contact with the distal end of the flange.

10. A method as claimed in claim 9, in which step (e) comprises pressing the second section of the die member toward the stop member.

11. A method of rigidly connecting plates with tubes to manufacture a muffler for use with an internal combustion engine, comprising the steps of:

(a) forming an eyelet through a plate such that a flange is produced which has an inside diameter substantially equal to the outside diameter of a tube, and has a portion substantially thick in the direction of the longitudinal axis of the tube;

(b) inserting the tube into said eyelet and fixing the tube in a predetermined position relative to the plate;

(c) preparing stop means for fixing the plate in position in contact with a flat surface of the plate where the flange is absent, and die means for folding the flange in cooperation with said stop means when driven along the longitudinal axis of the tube, said stop and die means each being formed with a recess having an inside diameter which is substantially equal to the outside diameter of the tube for receiving the tube therein, the recess of said die means being formed with an additional recess for receiving a portion of the flange therein, the recess of said stop means being formed with an additional recess for receiving a folded portion of the flange therein;

(d) positioning the stop and die means relative to the tube so that said recesses receive the tube therein to bring the stop and die means into abutment on the flat surface of the plate and the distal end of the flange, respectively; and (e) driving the stop and die means relatively to each other in the directions of the longitudinal axis of the tube until the portions of the flange received by the additional recesses are folded to thrust into the outer periphery of the tube.

* * * * *

UNITED STATES PATENT AND TRADEMARK OFFICE

CERTIFICATE OF CORRECTION

PATENT NO. : 4,547,942

DATED : October 22, 1985

INVENTOR(S) : Masuo Fukuda

It is certified that error appears in the above-identified patent and that said Letters Patent is hereby corrected as shown below:

Front page, left column, lines 3 and 4 should read:

Assignee: Sankei Giken Kogyo Kabushiki Kaisha, Tokyo, Japan

Signed and Sealed this

*Sixth* Day of *May 1986*

[SEAL]

*Attest:*

DONALD J. QUIGG

*Attesting Officer*

*Commissioner of Patents and Trademarks*